US006193636B1

(12) United States Patent
Chen

(10) Patent No.: US 6,193,636 B1
(45) Date of Patent: Feb. 27, 2001

(54) SWIMMING AUXILIARY DEVICE

(76) Inventor: Tzu-Sheng Chen, No. 66, Tsu-Chiang 2nd St, Wuchi Town, Taichung Hsien (TW)

( * ) Notice: Subject to any disclaimer, the term of this patent is extended or adjusted under 35 U.S.C. 154(b) by 0 days.

(21) Appl. No.: 09/323,540

(22) Filed: Jun. 1, 1999

(51) Int. Cl.[7] ..... A63B 21/008

(52) U.S. Cl. ..... 482/111; 441/60; 441/61; 441/62; 441/63; 441/64

(58) Field of Search ..... 482/111; 441/60–64

(56) References Cited

U.S. PATENT DOCUMENTS 2,792,577 * 5/1957 Boyers ..... 441/60

* cited by examiner

*Primary Examiner*—Jerome W. Donnelly
*Assistant Examiner*—Lori Baker Amerson
(74) *Attorney, Agent, or Firm*—Rosenberg, Klein & Lee

(57) ABSTRACT

A swimming auxiliary device includes an attaching member an attaching member mounted to the swimmer's calf or forearm, and a connecting device connected to the attaching member so as to pivotally connect a web member to the attaching member. A pulling device is connected between the web member and the attaching member to pull the web member toward the attaching member. When the swimmer pushes the water, the water flows between the web and the attaching member so that the web member is pivoted away from the by the water. The web member is then pulled by the pulling device to return its original position again when the water flows away from the web member.

9 Claims, 8 Drawing Sheets

SWIMMING AUXILIARY DEVICE

FIELD OF THE INVENTION

The present invention relates to a swimming auxiliary device which is attached to the foot and/or the hand of a swimmer and has a web member pivotally connected thereto which is pivoted away from the device to increase the water resistant area.

BACKGROUND OF THE INVENTION

Swimming is a good exercise but it is also a skilled exercise that the swimmer pushes the water backward to let the body move forward. In order to effectively push a large amount of water backward to produce a large force to push the swimmer's body, the swimmer has to adjust his/her wrists and ankles to let the hands and feet orient perpendicularly to the forward direction so as to push a larger amount of water. However, the areas of the hands and the feet are limited. Fins are therefore used to increase the area to push the water. Once the fins are worn on the feet, they will affect the actions of the swimmer in the water even when the swimmer does not need the resistant force. The swimmer cannot walk as those who have no fins on their feet so that the swimmer has to wear on the fins when he/she wants to swim, and remove the fins when he/she is on the shore. Furthermore, The fins occupy a large space and are convenient for being carried with the swimmer.

The present invention intends to provide a swimming auxiliary device which is attached to the calf or the forearm and has a pivotable web member which is expanded relative the calf or the forearm when pushing the water so as to effectively increase the areas to push the water backward. The present invention provides a convenient tool to assist the swimmer to swim more efficiently.

SUMMARY OF THE INVENTION

In accordance with one aspect of the present invention, a swimming auxiliary device is provided and includes an attaching member mounted to the swimmer's calf or forearm, and a connecting means connected to the attaching member to pivotally connect a web member to the attaching member. A pulling means is connected between the web member so as to pull the web member toward the attaching member.

The primary object of the present invention is to provide a swimming auxiliary device which has a web member pivotally connected to the attaching member which is mounted to the swimmer's calf or forearm. The web member can be pivoted away from the attaching member by the water when the swimmer pushes the water.

Further objects, advantages, and features of the present invention will become apparent from the following detailed description with appropriate reference to the accompanying drawings.

DETAILED DESCRIPTION OF THE PREFERRED EMBODIMENTS

Figure 1:
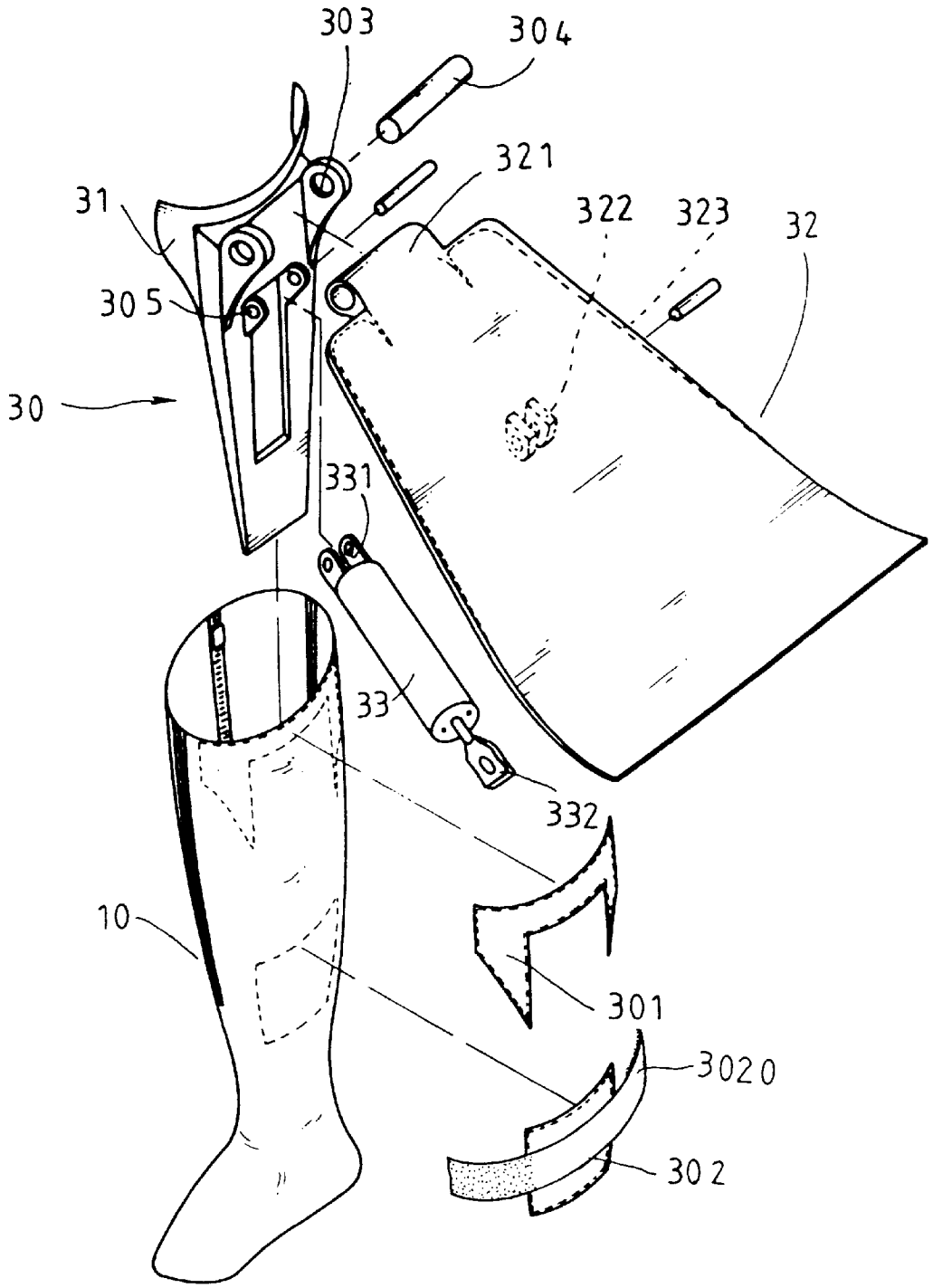
FIG. 1 is an exploded view of a first embodiment of the swimming auxiliary device in accordance with the present invention.
Figure 2:
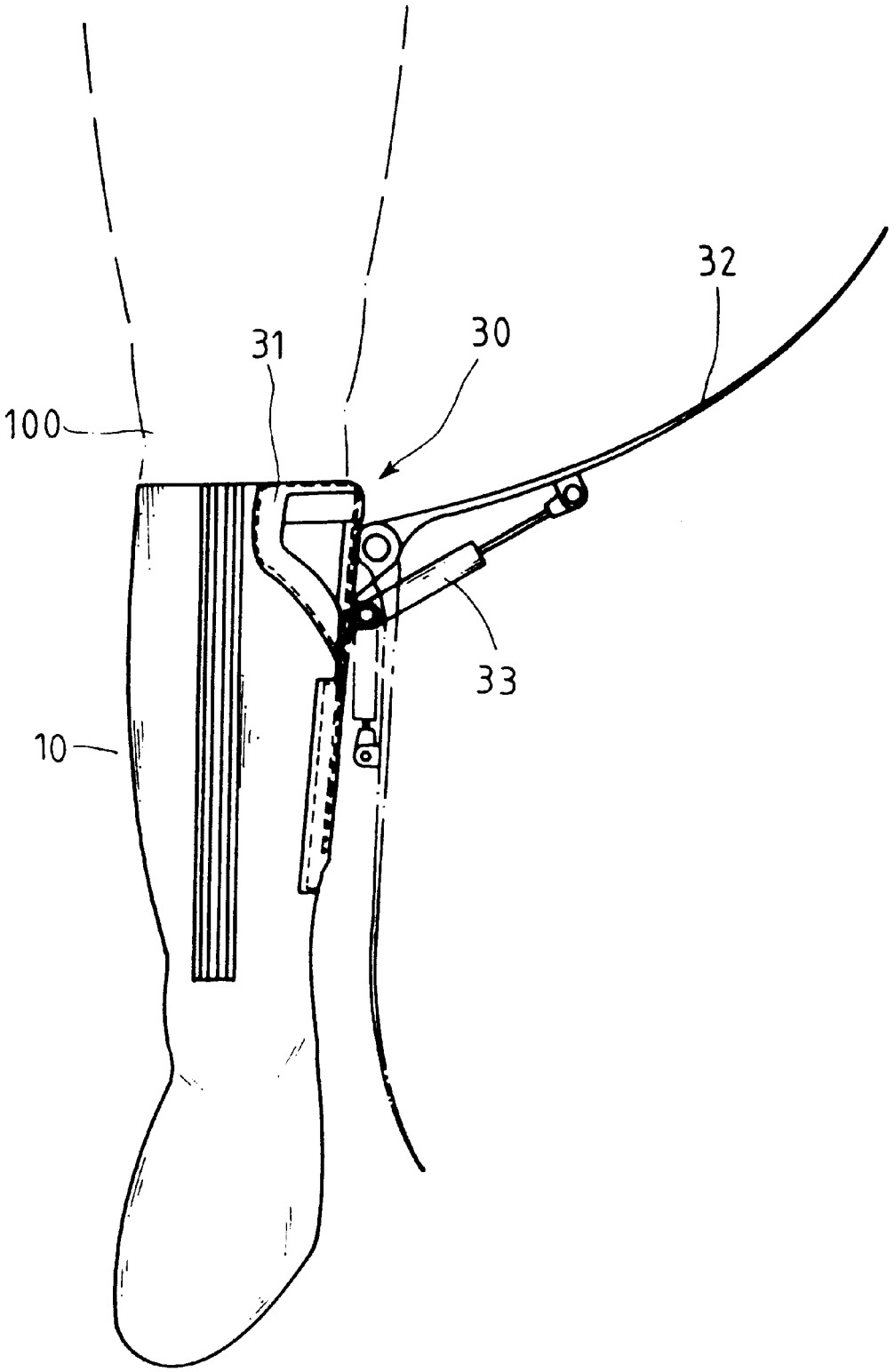
FIG. 2 is a side elevational view of the device as shown in FIG. 1 wherein the device is attached to the calf of a swimmer.
Figure 3:
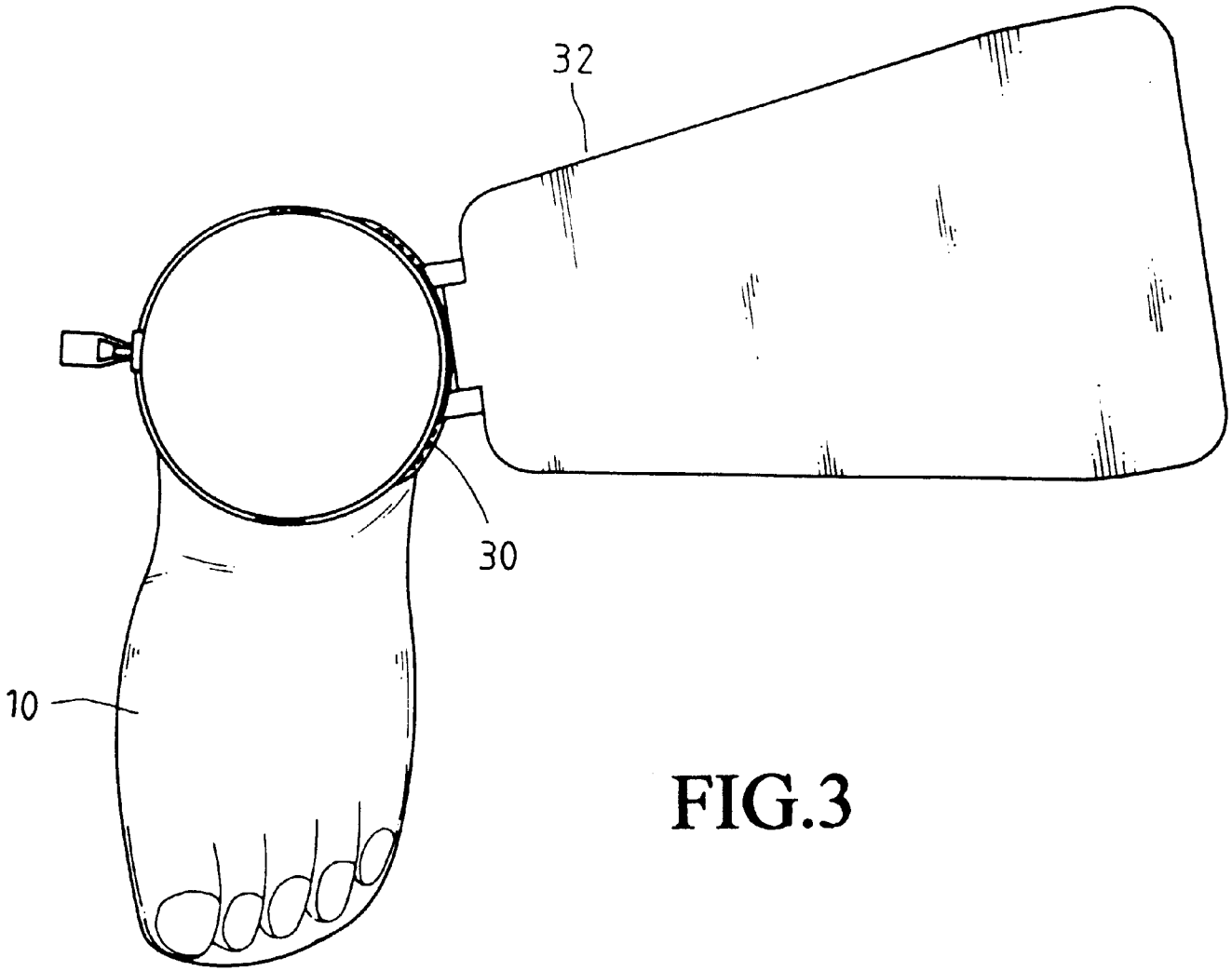
FIG. 3 is an illustrative view to illustrate when the web member is pivoted away from the attaching member on the calf.
Figure 4:
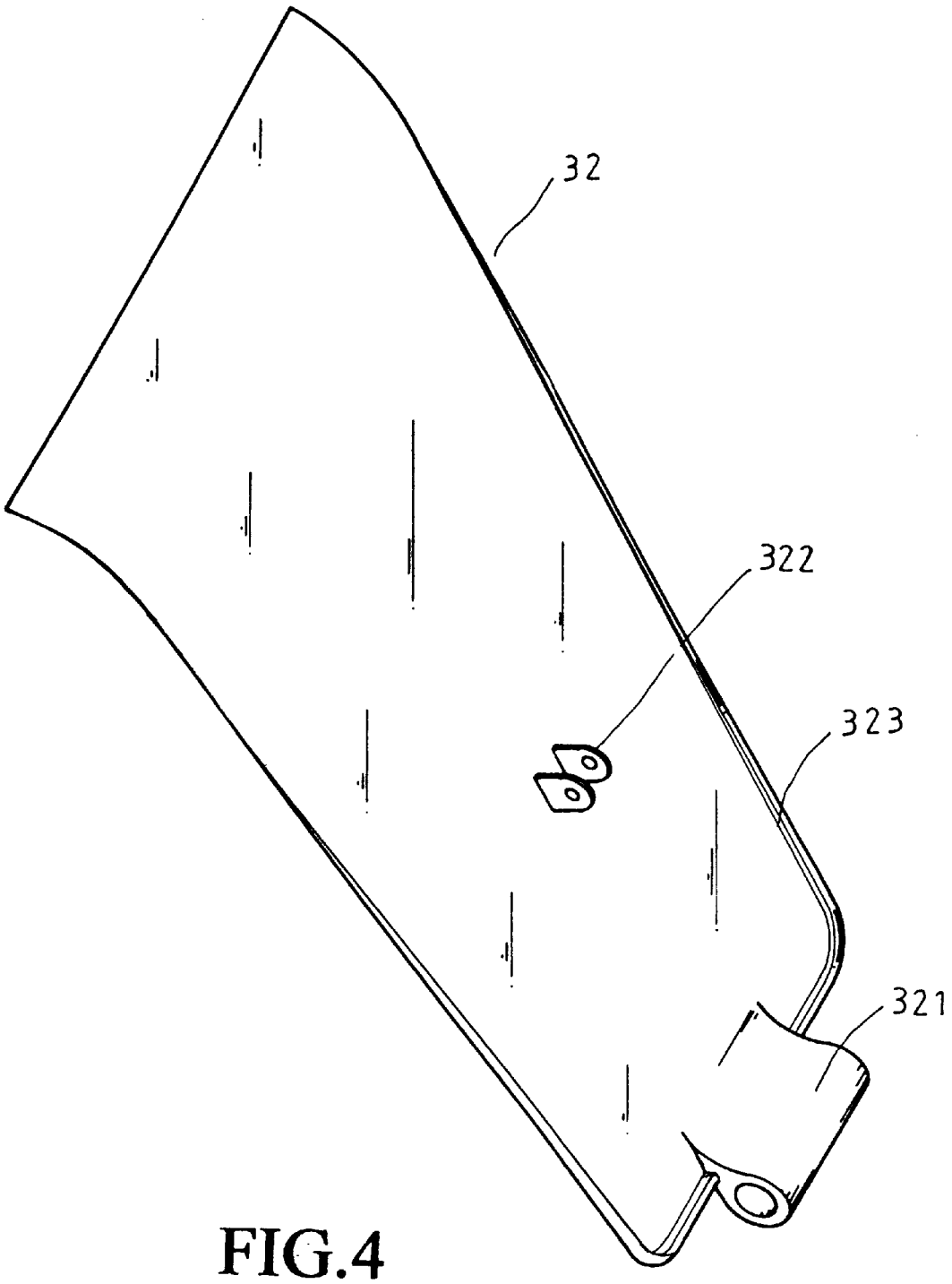
FIG. 4 is a perspective view of the web member in accordance with the present invention.

Referring to FIGS. 1 to 3, the first embodiment of the swimming auxiliary device in accordance with the present invention comprises an attaching member 10 having a connecting means 30 connected thereto so as to pivotally connect a web member 32 (see FIG. 4) connected to the attaching member 10. The attaching member 10 is like a boot having a tubular portion so the swimmer's calf 100 can be inserted into the tubular portion.

The connecting means 30 has two first lugs 303 extending from the outside thereof and the web member 32 has a transverse tube 321 connected to one of two ends thereof so that the transverse tube 321 is pivotally connected to the two first lugs 303 by a pin 304. Two second lugs 305 extend from the outside of the connecting means 30 and are located below the first lugs 303. The pulling means 33, a cylinder in this embodiment, has one end thereof pivotally connected to the two second lugs 305 by two lugs 331 extending from the cylinder, and the other end of the pulling means 33 has a piston rod 332 movably received in the cylinder, the piston rod 332 is pivotally connected to two lugs 322 on the bottom of the web member 32. The connecting means 30 has two curved plates 31 extending from the inside thereof so as to snugly attach to the attaching member 10. The web member 32 is made by flexible material and has a frame 323 received therein so as to maintain the shape of the web member 32.

When the swimmer kicks the water, the water flows in the area between the web member 32 and the attaching member 10 so that the web member 32 is pivoted away from the attaching member 10 as shown in FIG. 3 so that the area to push the water is increased. When the swimmer's leg is retracted, the water will push the web member 32 toward the attaching member 10 and the pulling means 33 also pulls the web member 32 toward the attaching member 10.

The connecting means 30 is securely attached to the attaching member 10 by two positioning members 301, 302, wherein the two positioning members 301, 302 may be sewed to the attaching member 10 to fix the connecting means 30. The positioning member 302 has a hook-loop strip 3020 so as to wrap around the attaching member 10 to more securely position the attaching member 10 on the calf 100.

Figure 5:
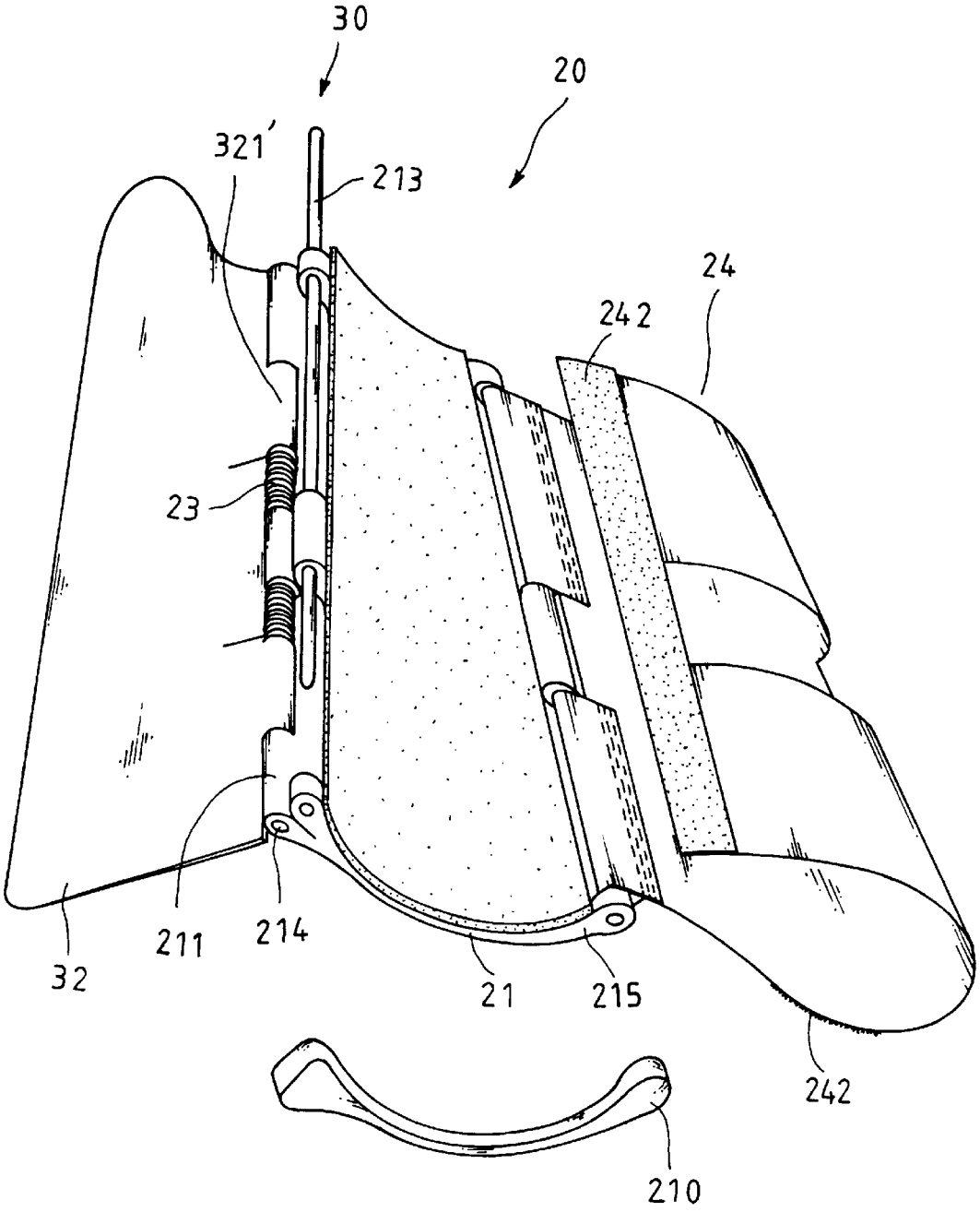
FIG. 5 is an exploded view of a second embodiment of the swimming auxiliary device in accordance with the present invention.
Figure 7:
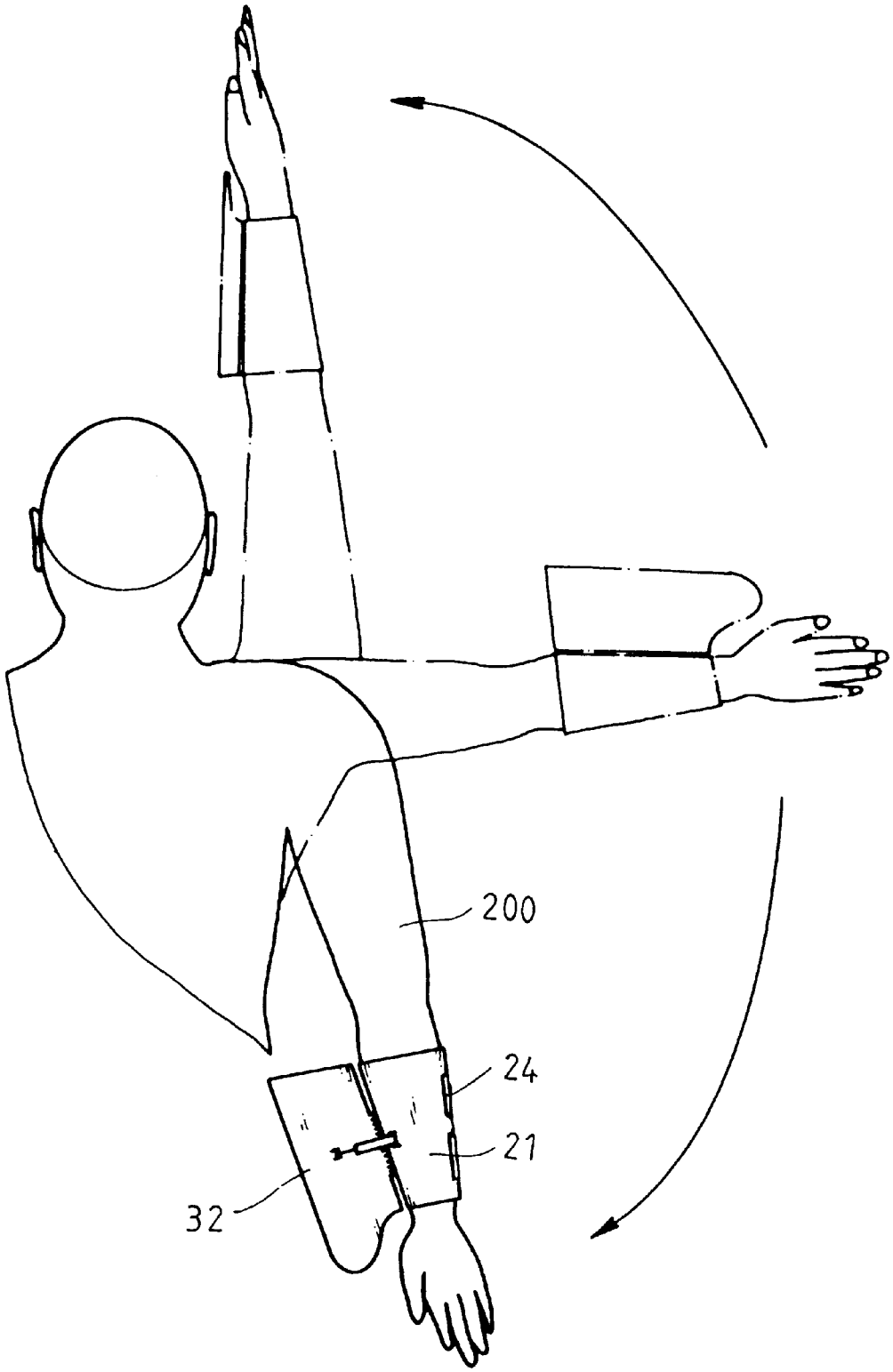
FIG. 7 is an illustrative view to illustrate the operation of the second embodiment of the swimming auxiliary device of the present invention.

Referring to FIGS. 5 and 7, the second embodiment of the device is designed to be attached to the swimmer's forearm 200, wherein the attaching member 20 is a flexible plate 21 and has a first side to which the connecting means 30 is pivotally connected so as to pivotally connect the web member 32. The connecting means 30 includes three tubular members 211 and the web member 32 has two tubular members 321' which are pivotally connected to the flexible plate 21 by extending a pin 214 through the tubular members 211, 321'. The second side of the flexible plate 21 has a tightening member 24 connected thereto which has hook-loop portions 242 so that the forearm 200 is wrapped by the flexible plate 21 and the tightening member 24. The distal end 25 of the tightening member 24 goes around the pin 213 and securely adheres to the outside of the tightening member 24 by the engagement of the two hook-loop portion 242 together. The pulling means is a torsion spring 23 which is mounted to the pin 214 and connected between the first side of the flexible plate 21 and the web member 32. A retaining member 210 is mounted to the end frame 215 on one of two ends of the flexible plate 21 so as to prevent the pins 213, 214 from disengaging from the end frame 215.

Figure 6:
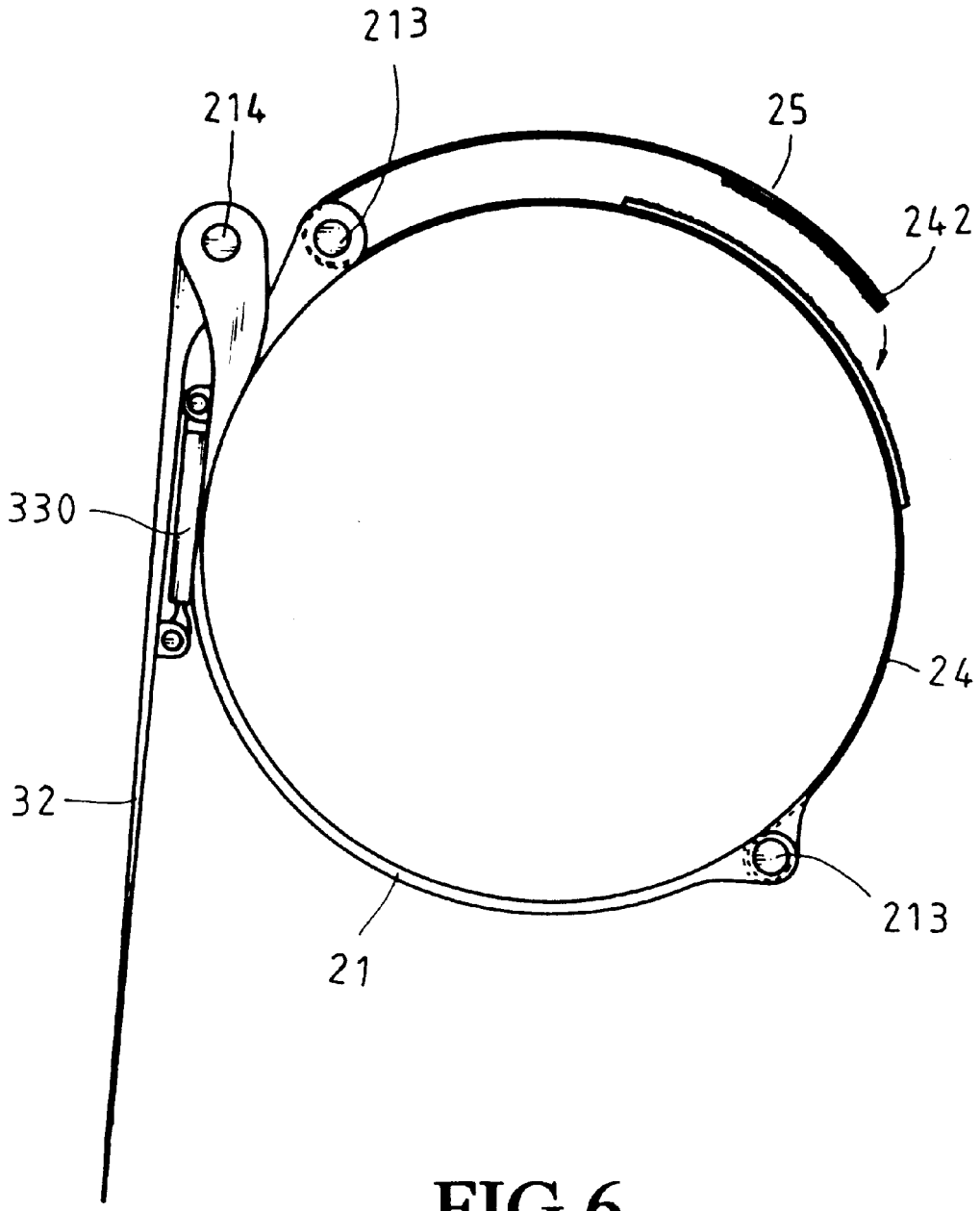
FIG. 6 is a plane view to show the swimming device as shown in FIG. 4, wherein the torsion spring is replaced by a cylinder.

When the arm of the swimmer pushes the water, the web member 32 is pivoted away from the flexible member 21 by the water and when the arm swings to the opposite direction, the web member 32 is pivoted toward the flexible member 21 by the water and the torsion spring 32. The torsion spring 23 can also replaced by a cylinder 330 as shown in FIG. 6.

Figure 8:
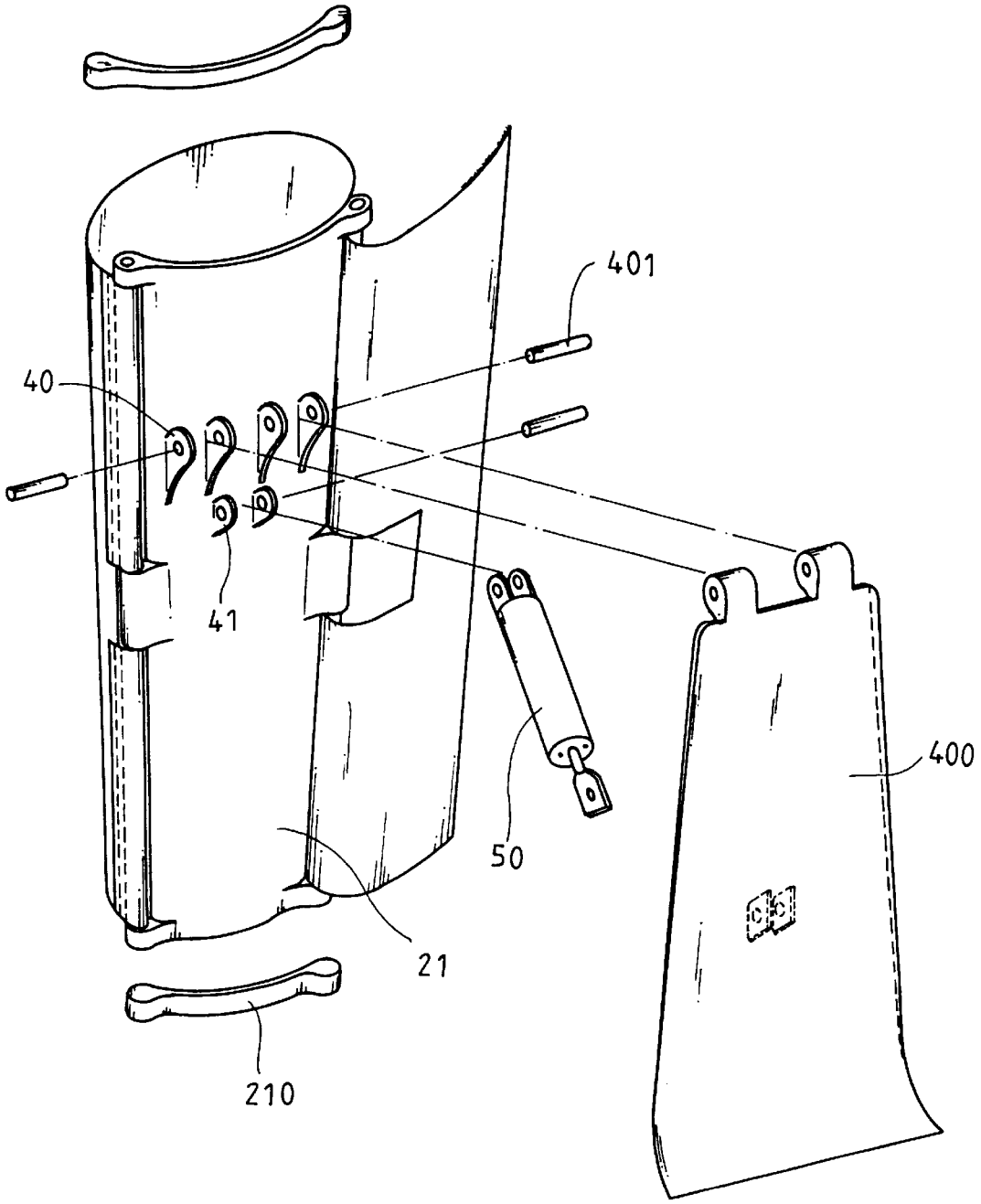
FIG. 8 is an exploded view of the third embodiment of the swimming auxiliary device in accordance with the present invention.

FIG. 8 shows a third embodiment of the present invention, wherein the flexible member 21 has four third lugs 40 extending from the outside thereof and a web member 400 is pivotally connected to the third lugs 40 by two pins 401. Two fourth lugs 41 are located below the third lugs 40 so as to pivotally connected the cylinder 50 which is pivotally connected to the web member 400. Similarly, a retaining member 210 is used to prevent pins from disengaging from the end frame.

The invention is not limited to the above embodiment but various modification thereof may be made. It will be understood by those skilled in the art that various changes in form and detail may made without departing from the scope and spirit of the present invention.

What is claimed is:

1. A swimming auxiliary device comprising:

attaching member having connecting means connected thereto and a web member pivotally connected to said connecting means, said connecting means having at least two lugs extending from the outside thereof, and pulling means connected between said web member and said attaching member to pull said web member toward said attaching member, said pulling means having one end thereof pivotally connected to said lugs and another end pivotally connected to said web member.

2. The swimming auxiliary device as claimed in claim 1, wherein said attaching member has a tubular portion.

3. The swimming auxiliary device as claimed in claim 1 wherein said connecting means has at least two additional lugs extending from the outside thereof for pivotally connecting said web member.

4. The swimming auxiliary device as claimed in claim 1, wherein said pulling means is a cylinder with a piston rod extending therefrom, said piston rod being pivotally connected to the bottom of said web member.

5. A swimming auxiliary device comprising:

an attaching member having connecting means connected thereto and a web member pivotally connected to said connecting means, pulling means connected between said web member and said attaching member to pull said web member toward said attaching member, and at least one positioning member securely positioning said connecting means on said attaching member.

6. The swimming auxiliary device as claimed in claim 5, wherein said at least one positioning member includes a hook-loop strip.

7. A swimming auxiliary device comprising:

an attaching member having connecting means connected thereto and a web member pivotally connected to said connecting means, pulling means connected between said web member and said attaching member to pull said web member toward said attaching member said connecting means having two curved plates extending from the inside thereof so as to snugly attach to said attaching member.

8. The swimming auxiliary device as claimed in claim 1, wherein said attaching member is a flexible plate and has a first side for said connecting means connected thereto, said connecting means pivotally connected to said web member, a second side of said attaching member having a tightening member connected thereto.

9. The swimming auxiliary device as claimed in claim 8, wherein a torsion spring is connected between the first side of said attaching member and said web member.

* * * * *